US005704125A

United States Patent [19]

Lee

[11] Patent Number: 5,704,125

[45] Date of Patent: Jan. 6, 1998

[54] ACUTATING LEVER FOR USE WITH A FINGER/TOE NAIL CLIPPER ASSEMBLY

[76] Inventor: Hee Un Lee, 9237 Austin, Morton Grove, Ill. 60053

[21] Appl. No.: 709,313

[22] Filed: Sep. 9, 1996

Related U.S. Application Data

[63] Continuation of Ser. No. 488,925, Jun. 9, 1995, Pat. No. 5,617,633.

[51] Int. Cl.[6] ..... A45D 29/02

[52] U.S. Cl. ..... 30/28; 132/75.5

[58] Field of Search ..... 30/28, 26–27, 30/29; 132/75.5, 73

[56] References Cited

U.S. PATENT DOCUMENTS

| | | | |
|---|---|---|---|
| 1,841,847 | 1/1932 | Peters | 30/28 |
| 4,117,591 | 10/1978 | Terry | 30/28 X |
| 4,574,475 | 3/1986 | Lee | 30/28 |

*Primary Examiner*—Douglas D. Watts
*Attorney, Agent, or Firm*—Sidney N. Fox

[57] ABSTRACT

An actuating lever for use with a finger/toe nail clipper assembly adapted to be mounted thereto, the actuating lever having a mounting assembly and an elongate lever portion coupled to the mounting assembly to enable the lever portion to be rotated between an active condition pivotal to force the cutting means of the assembly to engage a finger/toe nail introduced to the assembly for severance thereof and a passive condition rendering the lever portion incapable of engaging the said finge/toe nail in severing engagement. One embodiment is formed of a angled mounting portion and an elongate lever having a angled bend, said mounting portion and the angled bend coupled surface to surface enabling rotation of the lever between the active and passive conditions. A second embodiment provides a mounting disc and an elongate lever having a base and an elongate lever unitary therewith, the base pivotally mounted to the disc. The disc being rotatable at least 180 degrees within suitable slots formed in the assembly to carry the lever between active and passive conditions.

10 Claims, 7 Drawing Sheets

FIG.11
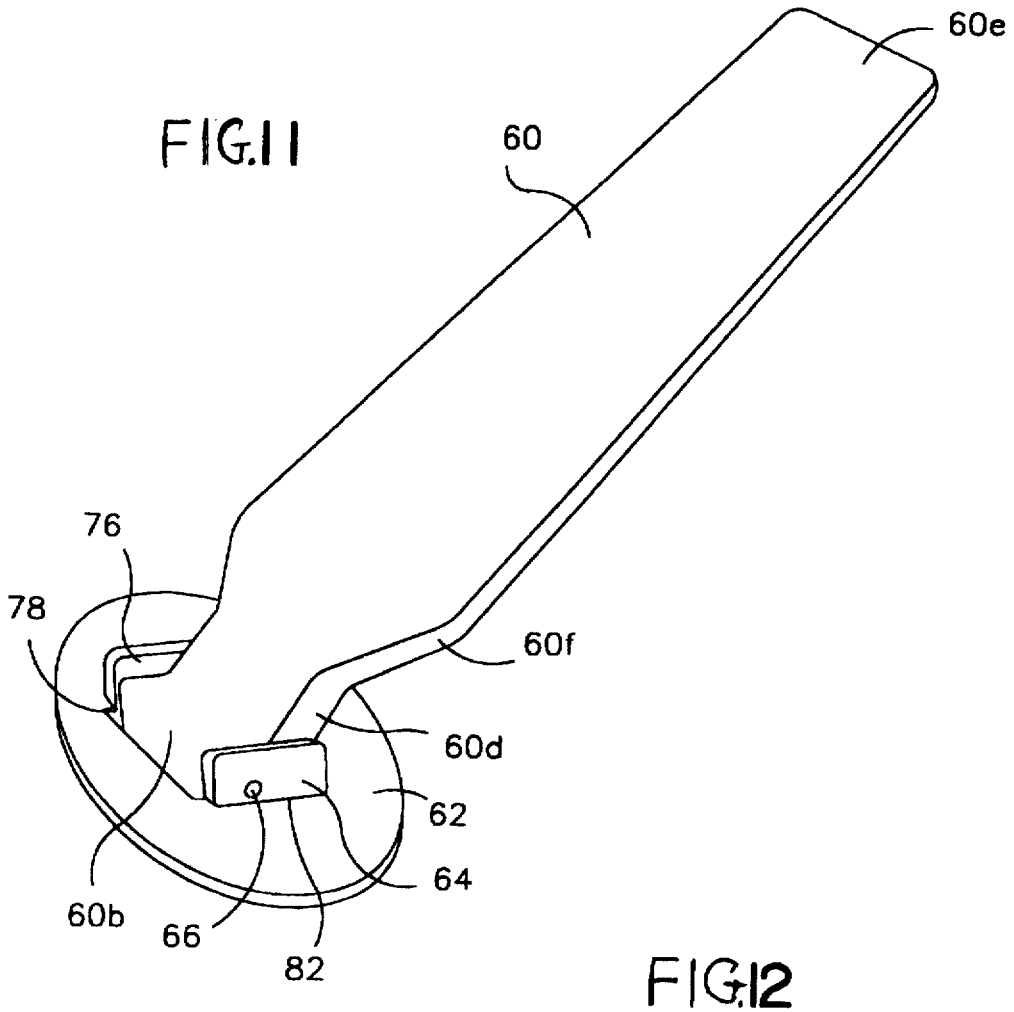
FIG.12
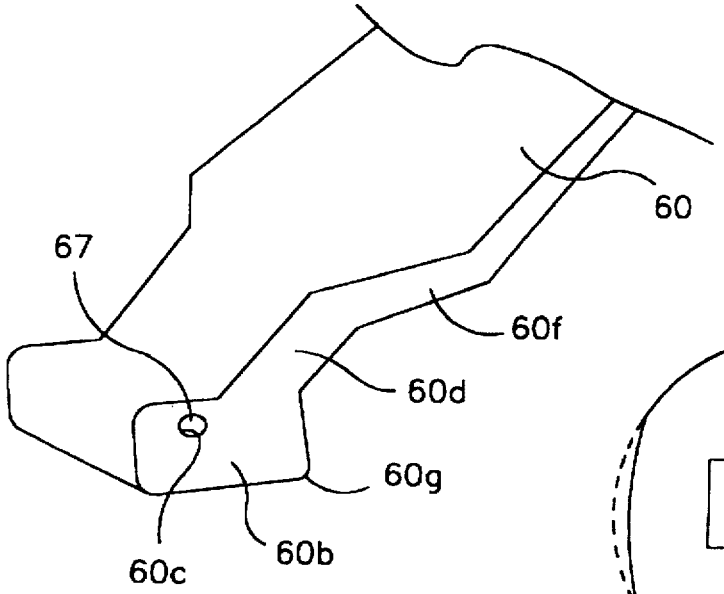
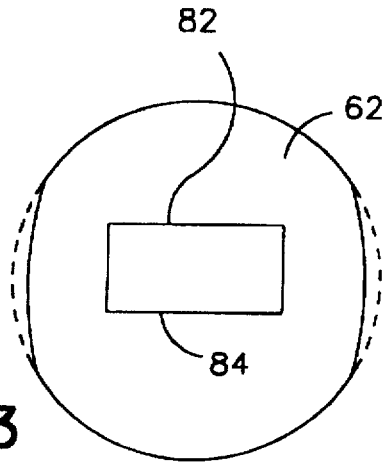
FIG.13

ACUTATING LEVER FOR USE WITH A FINGER/TOE NAIL CLIPPER ASSEMBLY

This application is a continuation of application Ser. No. 08/488,925, filed Jun. 9, 1995, (now U.S. Pat. No. 5,617, 633).

BACKGROUND

1. Field of the Invention

The present invention relates in general to a finger/toe nail clipper and catcher, and more specifically, the present invention relates to an actuating lever for a finger/toe nail clipper assembly, the actuating lever comprises a stationary front plate and a rotatable portion coupled together enabling the rotatable portion to be positioned between an active condition extending diagonally outward of the assembly and a passive disabled condition rendering the lever incapable of being effective to operate the assembly.

2. Prior Art

The conventional finger/toe nail clipper devices generally are made up of a pair of elongate arms arranged overlying and co-extensive. The upper arm has limited resilience while the lower arm is rigid. The longitudinal sides are generally open. The rear ends of the arms are secured. The front ends of the arms terminate in jaw formations, each arm terminating in cutting edges spaced apart slightly. The actuating lever is provided coupled to mounting means proximate the jaw formations.

The conventional mounting means of the actuating lever consist of a mounting pin having a head at one end and a passage at the other end. Each arm has a hole adjacent to the jaw area. These holes are aligned. The mounting pin passes through the aligned holes. The mounting pin, when conventionally installed, partially blocks the way between the jaws of the clipper, which limits the entry of the finger/toe nail. Also, the mounting pin obstructs the flow of the nail clippings toward the interior area of the clipper, resulting in the uncontrolled dispersal of finger/toe nail clippings common to the use of the conventional finger/toe nail clipper device.

While prior art has attempted to address these results through various proposed structures, none of the proposed structures have been totally successful in controlling the scattering of finger/toe nail clippings. Also, the removal of clippings from the storage areas of the prior art finger/toe nail clipper is difficult.

In order to provide background information so that the invention may be completely understood and appreciated in its proper context, reference is made to a number of prior art patents as follows:

U.S. Pat. Nos. 5,072,511; 5,150,521; 4,640,011; 5,195, 544; 4,984,366; 4,996,771; 5,131,146; 4,614,031; 4,419, 134; 4,574,475; and 5,261,160.

The Ro U.S. Pat. No. 5,072,511 discloses an attempt to deal with these difficulties. The structure involves a recess formed in the side walls to facilitate controlled catching and discharge of the clippings. While the structure does contain many clippings within the chamber formed by the side walls, there are open slots between the side walls and jaw formations that permit escape of some of the clippings that have rebounded from the interior surfaces of the jaws and the mounting pin, leaving a retrieval problem which was sought to be avoided. Also, the Ro clipper appears to require considerable shaking to discharge any clippings jammed in the interior, rear narrow portion of the clipper.

The U.S. Pat. No. 5,150,521 to Han provides a separate nail collecting box into which the nail clipper is slipped. A cover frictionally is engaged over a conventional clipper to retain the clippings. The Han solution requires a two-piece unit that is likely to be expensive to manufacture and difficult to separate in order to dispose of the accumulated clippings.

The Gamble U.S. Pat. No. 4,640,011 describes a hinged retainer with side walls that close off the side openings of the clipper. When the retainer section is dropped, the nail clippings fall out. However, to remove the nail clippings in the rear area of the interior chamber, the retainer must still be removed from the conventional nail clipper. Shaking is still required to dispose of clippings caught in the rear portion of the clipper.

U.S. Pat. No. 5,195,544 illustrates a sheath into which the conventional nail clipper is lodged. The sheath must be removed from the conventional clipper in order to discharge the accumulated clippings within the chamber. An additional element for collection and the separation of such element to remove the clippings is required, making it burdensome for the user.

U.S. Pat. No. 4,984,366 demonstrates another slip-on device whereby a tubular element is fitted onto the conventional clipper. However, the tube does not extend to the mouth of the clipper, still allowing escape of nail clippings deflected from the mounting pin and the interior of the blades out of the side slots.

The Williams U.S. Pat. No. 4,996,771 shows a clipper with a retainer and catching mechanism that catches nail clippings in the forward position and empties the clippings when in the rearward position. Random nail clippings may still deflect from the mounting pin.

The Leininger U.S. Pat No. 5,131,146 exhibits a receptacle that has a rear sleeve which receives the rear part of the finger/toe nail clipper as well as a front shield that receives the front portion of the finger/toe nail clipper and accommodates the nail clippings resulting from use of the clipper device. The front shield is attached to the rear sleeve by a "live" hinge that allows the front sleeve to be pulled away from the body of the clipper device about the hinge, enabling release of the clippings collected within the interior of the device. The interior side walls of the front shield engage to the lower arm of the clipper device. While the Leininger attachment may reduce the amount of scattered clippings, there is still a problem of uncontrolled dispersal with a portion of the clippings since they may, again, deflect from the mounting pin and out the open mouth of the cutting edges. Moreover, the Leininger shield and sleeve unit is a plastic molded product that fits a particular size clipper device, necessitating several sizes of the shield/sleeve unit. Also, it is likely that the plastic molded receptacle will not last an adequate useful life.

The Chen U.S. Pat. No. 4,614,031 divulges a nail clipper with a lower stationary base and side walls that house the clippings within the clipper device. However, there are side slots between the jaw formations and the side walls of the base where random nail clippings may escape.

The Bumbera U.S. Pat. No. 4,419,134 evinces an attempt to eliminate the deflection problem of the mounting pin by mounting the actuating lever by means of the end of the actuating lever hooked on the band circled around the lower and upper arms of the clipper. The Bumbera structure has open side walls, which still allows the scattered escape of nail clippings. However, even if the Bumbera design had side walls, the band would prevent the front portion of the clipper to be shielded, resulting in incomplete protection against scattered escape.

U.S. Pat. No. 4,574,475 to Lee presents side walls extending from the jaw area and terminating at the rear area of the device. However, the Lee structure allows for nail clippings to be caught in the narrowed rear portion of the device, resulting in difficult removal of the clippings. Also, forward opening end notches or slots in the side walls allow the passage of random nail clippings.

The Castagna U.S. Pat. No. 5,261,160 also introduces side walls to shield the length of the nail clipper. However, the conventional mounting pin still presents the problem of deflection.

Whatever the precise merits, features, and advantages of the above cited references, none of them achieves or fulfills the purposes of the present invention.

SUMMARY OF THE INVENTION

Several objects of the present invention are:

(1) to allow greater protection against dispersal of nail clippings by complete enclosure of the interior during use;

(2) to eliminate deflection of clippings off of the conventional mounting pin by providing alternate mounting means for the actuating lever;

(3) to allow various-sized nails to be clipped without sacrificing complete enclosure of the interior during use;

(4) to provide more controlled means for removing the accumulated nail clippings by a simple mechanism without any separate attachment units;

(5) to simplify the manufacture and operation of the device;

(6) to present a single unit free from the need for separate units suggested by prior art.

In accordance with the present invention, a finger/toe nail clipper and catcher comprises vertical side walls unitary with the elongate lower arm of the clipper device, said side walls formed along the longitudinal edges of said elongate upper and lower arms to shield the area between said arms along the continuous length of the device. Said elongate upper arm is of limited resilience and bends downward towards the rear end of the clipper and is tightly secured to the elongate lower arm at the rear of the device by a rivet and spot welding. Preferably, a disposal hatch on the undersurface of said lower arm will cover an opening in said lower arm proximate the rear of the device, said disposal hatch mounted to the device by the same rivet fastening said upper and lower arms. Said disposal hatch swings sideways about said rivet to expose said hole in said lower arm. The upper and lower arms terminate in the front area of the device in spaced and facing jaw formations, said jaw formations having concave center blade sections and side blade sections engaged between said center blade sections and the beginnings of said side walls, said side blade sections serving as movable slots, said center and side blade sections with terminal cutting edges, said arms and side walls completely enclosing the interior chamber when the blade sections are engaged in the "cutting" position. Means mounting said actuating lever will enable rotational pivoting of said actuating lever. Preferably, said actuating lever comprises a stationary front plate and a rotating portion, a rivet tightly fastens said rotating portion to said front plate, said front plate mounted to said side walls, thus preventing pivoting movement of said actuating lever when said actuating lever is in active position and allowing pivoting movement of said actuating lever when said actuating lever is vertically raised to proceed to inactive position.

BRIEF DESCRIPTION OF THE DRAWINGS

FIG. 11 is a perspective view of the modified actuating lever and rotational disc used in the finger/toe nail clipper in FIG. 8.

FIG. 12 is a fragmentary view of the actuating lever in FIG. 11.

FIG. 13 is a top view of the rotational disc means in FIG. 8.

LIST OF REFERENCE NUMERALS

Figure 1:
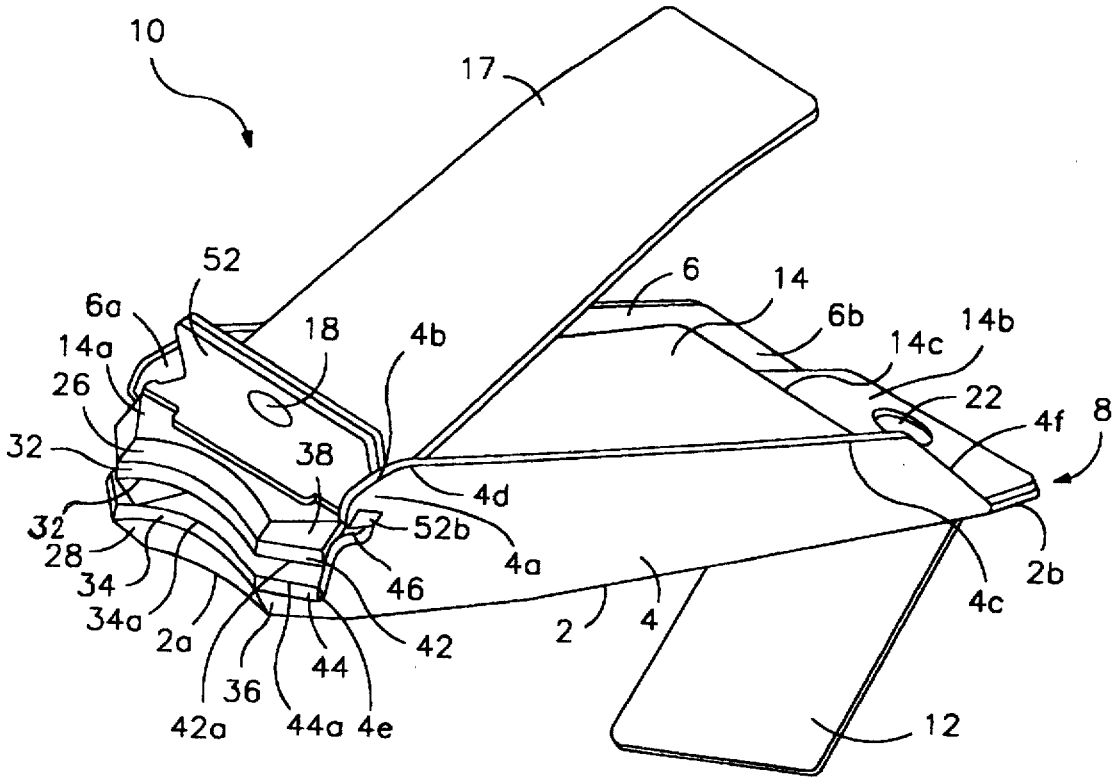
FIG. 1 is a perspective view of the preferred finger/toe nail clipper in accordance with the present invention with the preferred actuating lever in active position and with the preferred disposal hatch extended sideways.

2 lower arm
**2*a*** lower arm's jaw formation
**2*b*** lower arm's rear fastened end
**2*c*** lower arm's opening for disposal
4 side wall
**4*b*** side wall's front edge
**4*c*** side wall's upper edge
**4*d*** dip
**4*e* bend where side wall 4 meets lower arm 2 and lower side blade section 36**
**4*f*** side wall's diagonal upper edge
6 side wall
**6*a*** side wall's front edge
**6*b*** side wall's diagonal upper edge
8 fastened end
10 preferred embodiment
12 disposal hatch
13 angled deflector
14 upper arm
**14*a*** upper arm's jaw formation

14b upper arm's fastened portion
14c point where upper arm bends downward
15 lower arm's opening
16 actuating lever
17 actuating lever's rotating portion
17a angled portion
17b grasping end
17c elongate section with cavity
17e heel formation
17f angled portion
17g rounded edge
18 rivet fastening rotating portion 17 to front plate 52
20 invention with modified disposal means
22 rivet fastening upper 14 and lower 2 arms and disposal hatch 12
24 interior chamber
26 upper concave center section
28 lower concave center section
30 invention with modified mounting means and modified actuating lever
32 upper concave center blade section
32a sharpened cutting edge of upper concave center blade section 32
34 lower concave center blade section
34a sharpened cutting edge of lower concave center blade'section 34
36 lower angular side section
38 upper angular side section
42 upper angular side blade section
42a sharpened cutting edge of upper angular side blade section 42
44 lower angular side blade section
44a sharpened cutting edge of lower angular side blade section 44
46 passage means (socket)
52 front plate
52a front plate's angled portion
52b front plate's protruding end
52c front plate's rounded front edge
52e front plate's protruding end
60 modified actuating lever
60b base
60c cavity
60d indented portion
60e gasping edge
60f diagonally indented portion
60g modified actuating lever's 60 heel formation
62 planar member
64 mounting ear
66 mounting ear's cavity
68 indented parallel section of side wall 4
70 diagonal indentation of side wall 4
72 diagonal indentation of side wall 4
74 passage means (slots)
76 mounting ear
78 axial passage
82 edge of axial passage
84 edge of axial passage, opposite of 82

DESCRIPTION OF THE PREFERRED EMBODIMENT

The preferred embodiment of the present invention (designated by character reference 10) will now be described in connection with FIGS. 1 through 5 of the drawing. Refer now to FIG. 1, which is an overall drawing of the preferred embodiment of the invention 10.

The finger/toe nail clipper and catcher 10 has an elongate upper arm 14 and elongate lower arm 2 that are generally spaced in overlying arrangement. Said elongate arms' 2 and 14 longitudinal edges are parallel or nearly parallel. Said upper arm 14 bends downward at 14c proximate the fastened end 8 of the device 10. The finger/toe nail clipper and catcher 10 has vertical side walls 4 and 6 that shield the open longitudinal sides of the overlying upper arm 14 and lower arm 2. The elongate lower arm 2 is unitary with the vertical side walls 4 and 6 along the longitudinal edges of the lower arm 2 from proximate the fastened end of the device 8 to the beginning of the elongate lower arm's 2 jaw formation 4e.

The rear ends of the elongate upper arm 1a and lower arm 3a are highly secured together. The opposite ends of the elongate upper arm 14 and the elongate lower arm 2 end in spaced facing jaw formations 14a and 2a. The jaw formations 14a and 2a have concave center sections 26 and 28 and angular side sections 36 and 38 on either side of said concave center sections 26 and 28. The concave center sections 26 and 28 of the jaw formations 14a and 2a have tapered blades 32 and 34 that end in sharpened cutting edges 32a and 34a. The angular side sections 36 and 38 have tapered blades 42 and 44 that terminate in sharpened cutting edges 42a and 44a.

The side walls 4 and 6 have diagonal upper edges 4f that gradually extend upward and flatten out at 4c until making a dip 4d proximate the jaw formations 14a and 2a. The front edge 4b of each side wall 4 dips down and terminates in a hook-like socket 46.

An interior chamber 24 of the device 10 is isolated by the interior facing surfaces of the lower arm 2, upper arm 14, side walls 4 and 6, jaw formations 14a and 2a, blades 32 and 34 and 42 and 44, and cutting edges 32a and 34a and 42a and 44a. When the cutting edges 32a and 34a and 42a and 44a bear against each other to cut a finger/toe nail, the interior chamber 24 is completely enclosed, preventing dispersal of finger/toe nail clippings.

The present invention does not have the mounting pin found in the conventional finger/toe nail clipper. The lack of a mounting pin eliminates problems with the conventional clipper. The lack of a mounting pin means that (1) there is no structure to obstruct the smooth entry of various-sized finger/toe nails between the jaw formations and (2) there is no structure in the path of the clippings that could deflect said clippings to the exterior of the device 10. Thus, in the present invention, there is no mounting pin, and other mounting means for the actuating lever are proposed.

Figure 3:
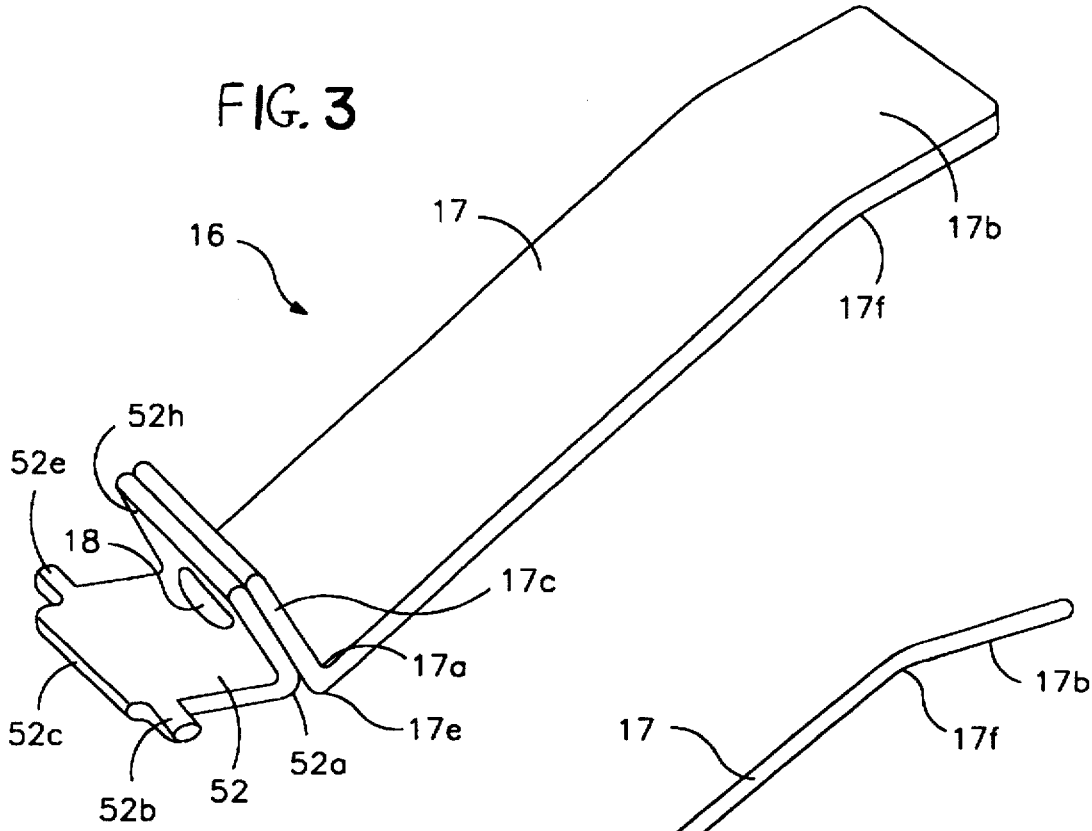
FIG. 3 is a perspective view of the preferred actuating lever from FIG. 1.
Figure 4:
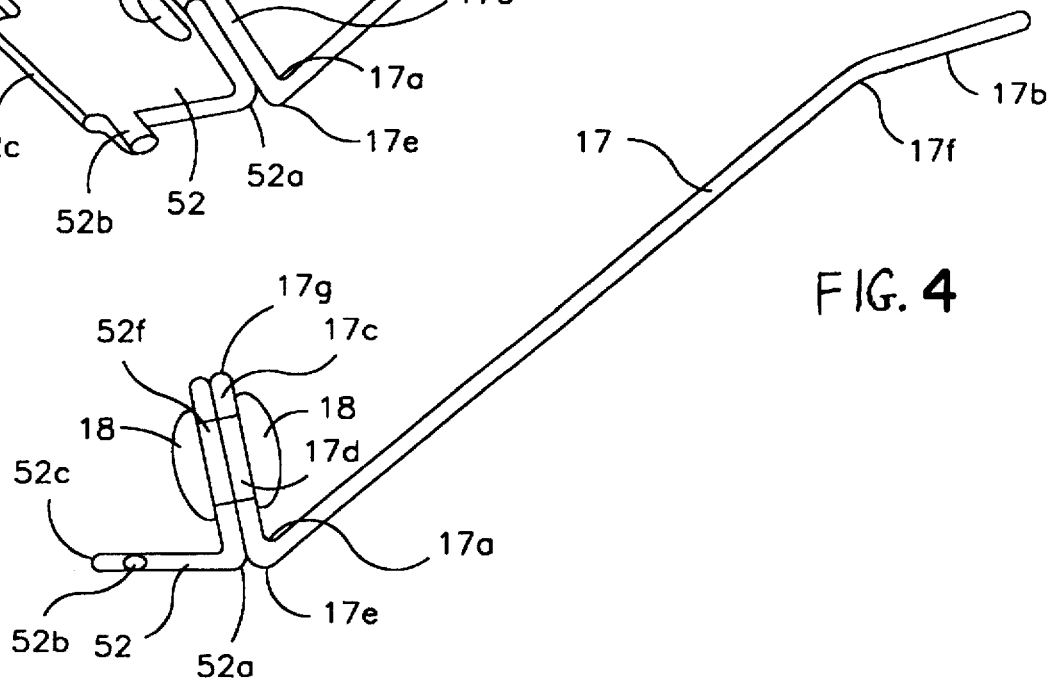
FIG. 4 is a side view of the preferred actuating lever in FIG. 3 in its active position.
Figure 5:
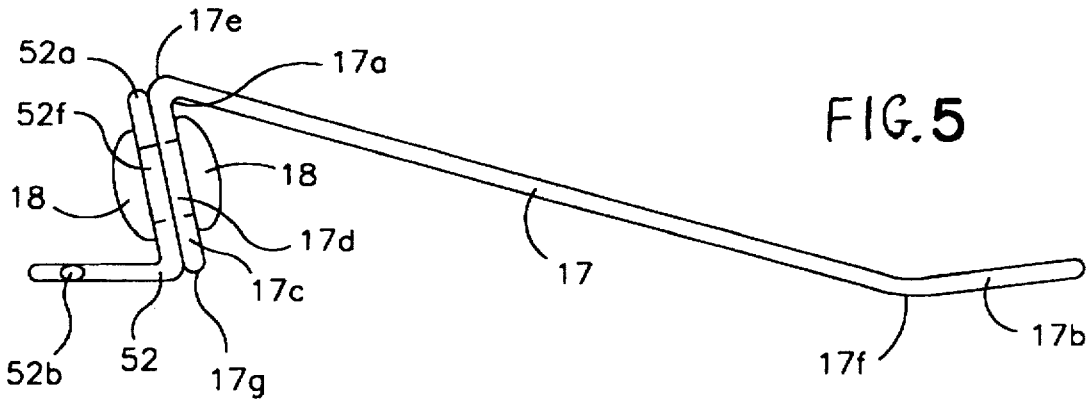
FIG. 5 is a side view of the preferred actuating lever in FIG. 3 in its inactive position, rotated 180 degrees about the rivet fastening the rotating portion of the actuating lever to the front plate.

Refer now to FIGS. 3 through 5, which represent different perspectives of the preferred actuating lever designated by character reference 16. The actuating lever's 16 rotating portion 17 is generally flat and is bent at 17f, continuing in an elongate planar section that forms the grasping end 17b. The opposite end of the actuating lever's 16 rotating portion 17 is bent at 17a, continuing in another elongate section 17c that has a cavity 17d for a fastening rivet 18. The bend at 17a forms a heel formation 17e of the actuating lever 16. The bend at 17a is at such an angle so that the point at 17g is parallel with the bend at 17f when the actuating lever 16 is in its inactive position (FIG. 5). The front plate 52 of the actuating lever 16 is the connecting piece that forms the mounting means for the actuating lever 16 to the side walls 4 and 6 of the device 10. The front plate 52 bends at 52*a*, and there is a cavity 52*f* in the front plate 52 for the fastening rivet 18. The rivet 18 tightly fastens the rotating portion 17 of the actuating lever 16 to the front plate 52 through their aligned cavities 17*d* and 52*f*, providing the pieces with steadiness and support. However, the rivet 18 still allows the rotating portion 17 to rotate 360 degrees to alternate between the active position portrayed in FIG. 4 and the inactive position depicted in FIG. 5 and vice versa.

The front plate 52 has opposite protruding, ends 52*b* and 52*e* and a front edge 52*c* that extends from the protruding ends 52*b* add 52*e*. The ends 52*b* and 52*e* ride within the sockets 46 formed by the side walls 4 and 6, enabling the actuating lever 16 to be mounted to the finger/toe nail clipper and catcher 10.

When the actuating lever 16 is in its active position (as portrayed in FIGS. 1, 3, and 4), the rotating portion 17 of the actuating lever 16 slopes upward, away from the elongate upper arm 14 with the heel formation 17*e* against the upper surface of the upper arm 14. In its active condition, the front area 4*a* and 6*a* of the side walls 4 and 6 provide side barriers for the actuating lever 16, preventing the actuating lever 16 from slipping sideways during use of the device 10. During use of the device 10, the grasping end 17*b* is pressed toward the upper arm 14. The heel formation 17*e* bears against the upper surface of the upper arm 14, forcing the upper jaw formation 14*a* of the upper arm 14 against the lower jaw formation 2*a* so that the cutting edges 32*a* and 34*a* and 42*a* and 44*a* engage against the finger/toe nail introduced between the jaw formations 14*a* and 2*a*, cutting said nail. When the device is in the process of cutting a nail, the interior chamber (24 of FIGS. 1 and 6) is completely isolated.

In order for the actuating lever 16 to alternate between the active and inactive positions, the gasping edge 17*b* must be lifted upward and then rotated 180 degrees around the rivet 18. When the actuating lever 16 is in its inactive position (as represented in FIG. 5), the rotating portion 17 of the actuating lever 16 is rotated 180 degrees from its active position. When the actuating lever 16 is in its inactive condition, the rotating portion 17 slopes downward, towards the upper surface of the elongate upper arm 14 with the heel formation 17*e* pointing upwards instead of bearing against the upper surface of the upper arm 14.

Figure 2:
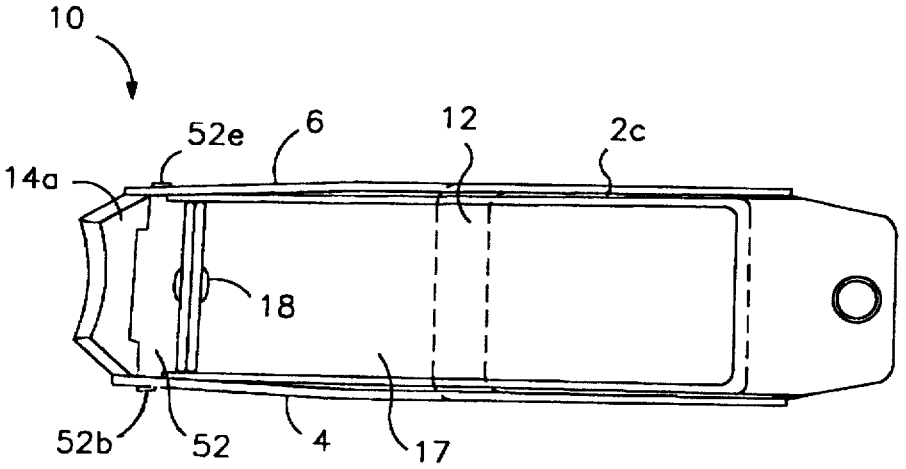
FIG. 2 is a top view of the finger/toe nail clipper portrayed in FIG. 1, with the preferred actuating lever in its active position and disposal hatch means in phantom outline.

In FIG. 1, the finger/toe nail clipper and catcher 10 is depicted with the disposal hatch 12 mounted to the undersurface of the lower arm 2 by the rivet 22 that also fastens the elongate upper arm 14 and elongate lower arm 2 together, said disposal hatch 12 extended sideways about the rivet 22 away from the body of the device 10 in FIG. 1. Refer now to FIG. 2. During the "cutting" stage, the disposal hatch 12 (depicted in phantom outline in the undersurface of the lower arm 2) is closed, covering the opening 2*c* where the accumulated nail clippings may be released. Refer back to FIG. 1. When the user is ready to dispose of the nail clippings collected within the chamber (24 of FIG. 6), the disposal hatch may be opened by swinging the hatch 12 to the side, allowing controlled means of discarding the accumulated nail clippings.

Figure 6:
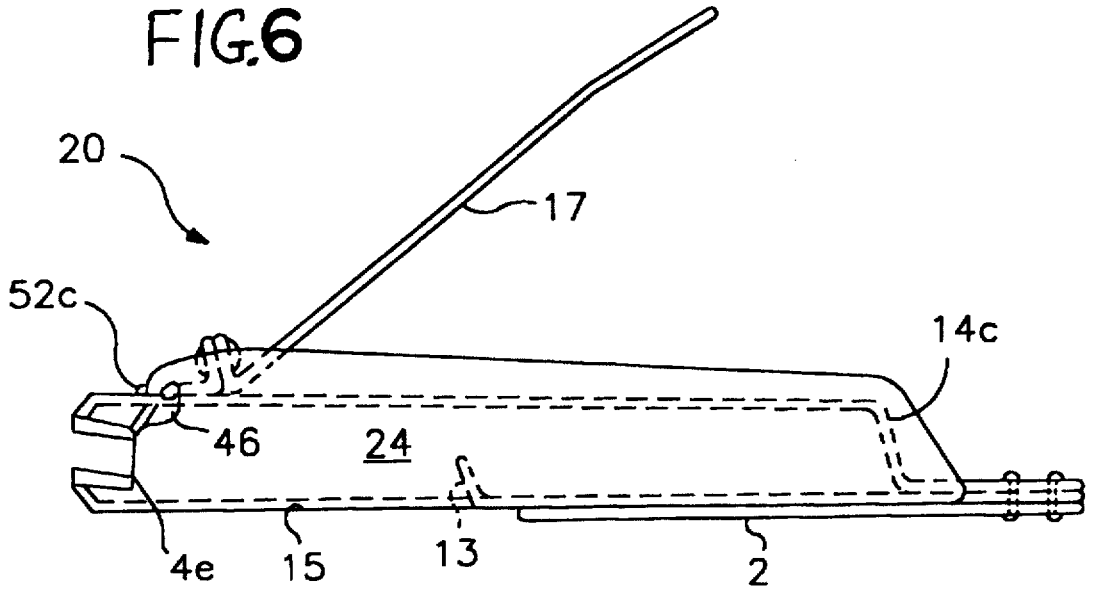
FIG. 6 is a side view of the finger/toe nail clipper depicted in FIG. 1 with modified deflection disposal means and upper and lower arms in phantom outline.
Figure 7:
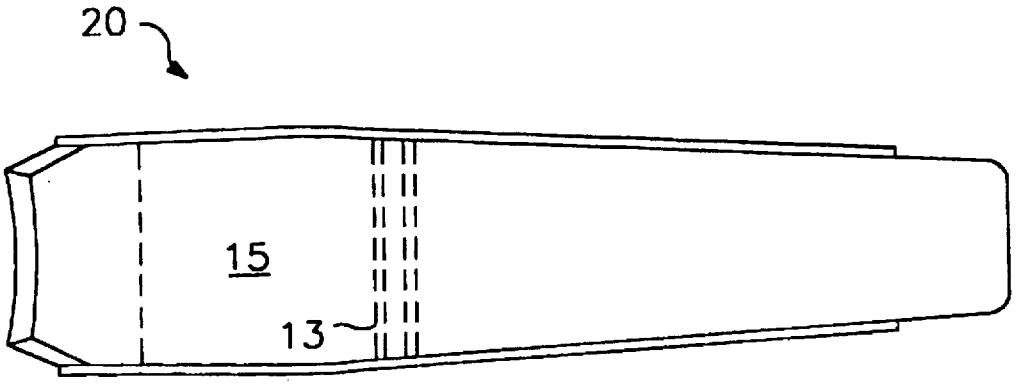
FIG. 7 is a top view of the finger/toe nail clipper in FIG. 1, showing the modified deflection disposal means in phantom outline.
Figure 8:
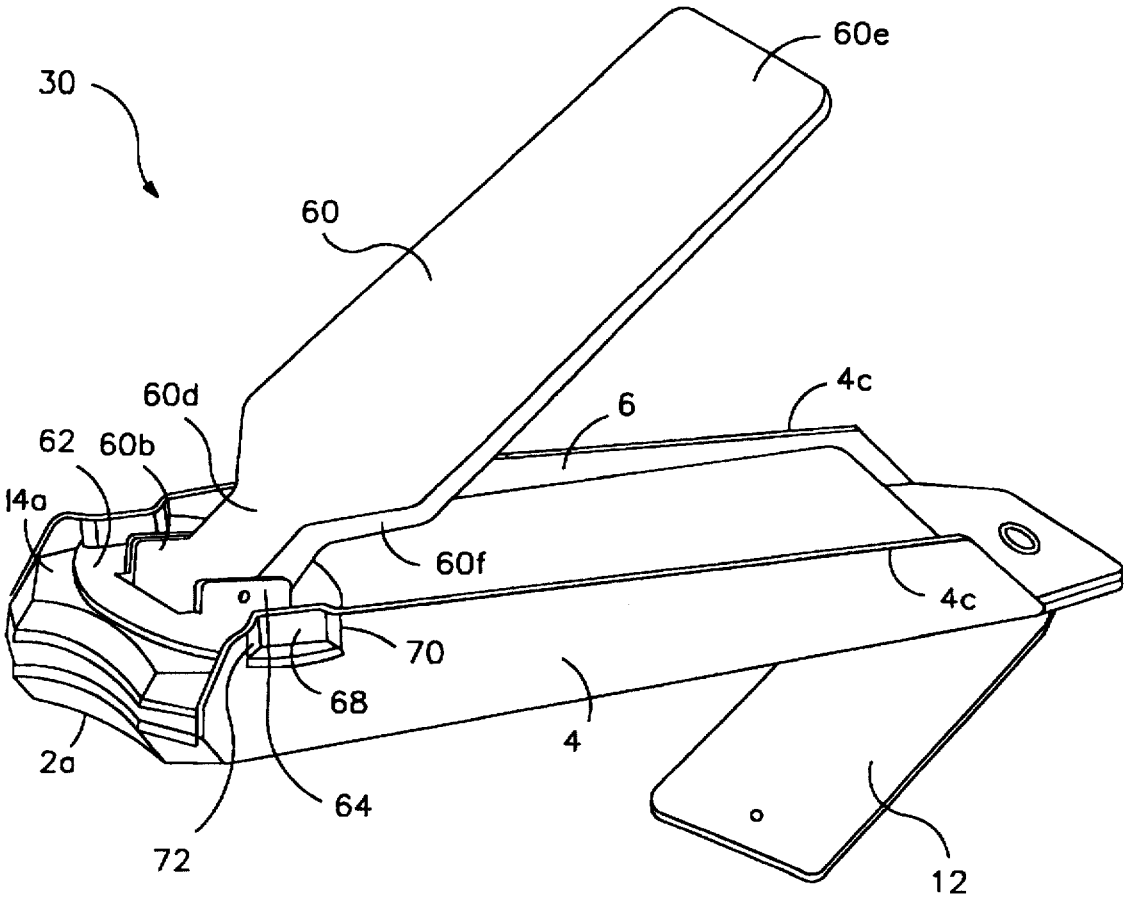
FIG. 8 is a perspective view of a modified embodiment of the finger/toe nail clipper depicted in FIG. 1 with the active actuating lever mounted by rotational disc means.
Figure 9:
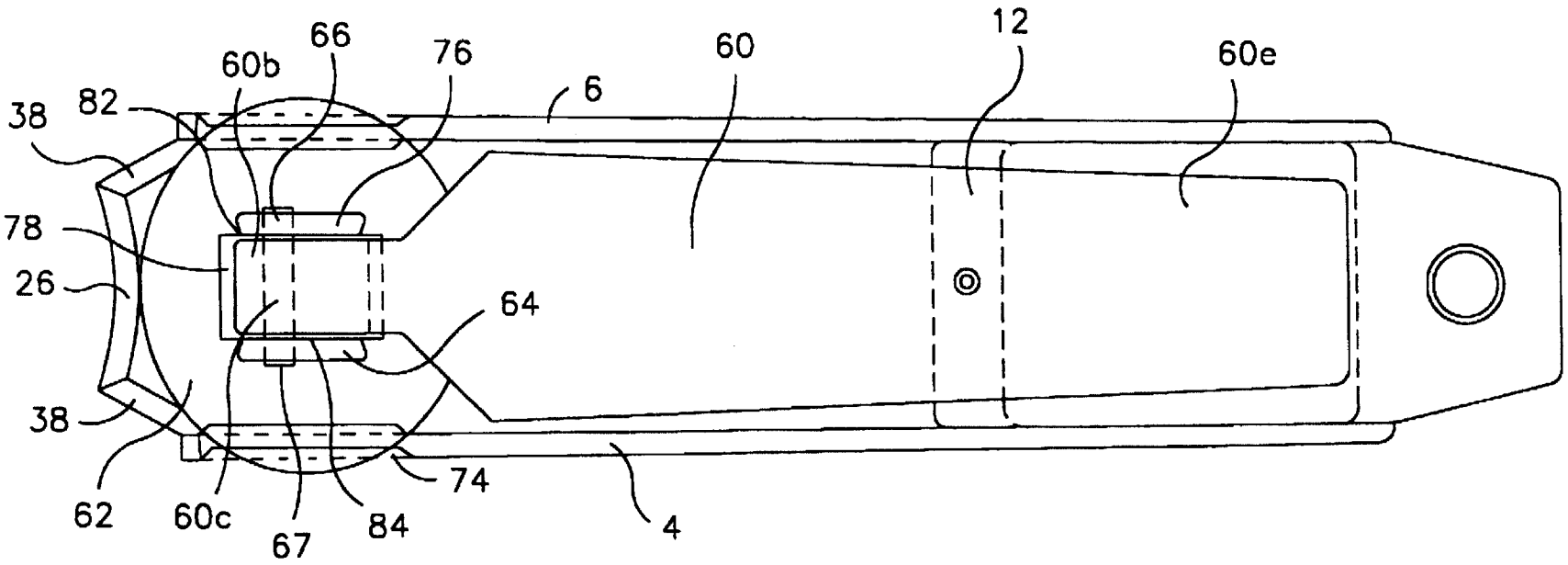
FIG. 9 is a top view of the finger/toe nail clipper in FIG. 8, with the preferred deflection disposal means in phantom outline.
Figure 10:
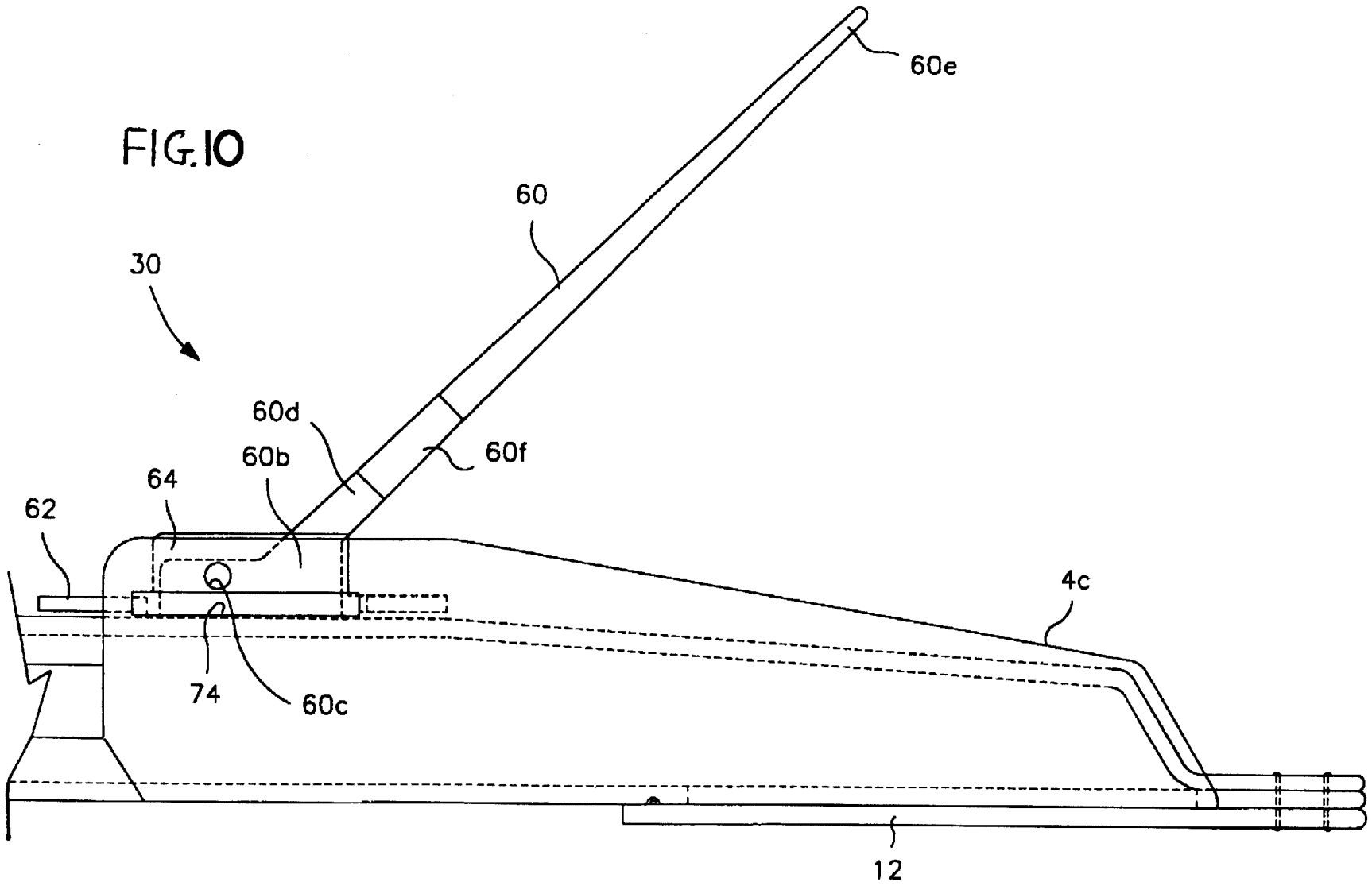
FIG. 10 is a fragmentary side view of the finger/toe nail clipper in FIG. 8, with the base or foot of the actuating lever and the upper and lower arms in phantom outline.

Refer to FIGS. 6 and 7, which represent a modified embodiment (designated by character reference 20) of the present invention's disposal means illustrated in FIG. 1. In FIG. 6, the phantom outlines reveal the interior chamber 24 and the deflection disposal means 13 located on the interior surface of the lower arm 2. In FIG. 7, the phantom outlines reveal the opening 15 in the interior surface of the lower arm 2. The angled deflector 13 provides controlled means of disposing of nail clippings. The lack of a mounting pin still allows for unobstructed entry of the nail clippings. However, instead of retaining the nail clippings for later disposal, in the modified disposal means 20, one can hold the device 10 above any container or other area of disposal. The deflector 13 will deflect nail clippings, which will then fall down through opening 15 in the lower arm 2 to the exterior of the device 10, providing controlled disposal of the finger/toe nail clippings. The deflector 13 does not extend all the way to the inner surface of the upper arm 14. It is sufficient that the deflector 13 extends upwards a sufficient distance without preventing the upper arm's 14 resilience, allowing the jaw formations 14*a* and 2*a* to engage the cutting edges 32*a* and 34*a* and 42*a* and 44*a*.

Referring to FIGS. 8 to 12, a modified embodiment of the present invention 10 is depicted and indicated by character reference 30. The modified embodiment 30 includes modified mounting means for the actuating lever. The actuating lever 60 is generally flat with a grasping end 60*e* and mounting base 60*b*. The actuating lever's 60 longitudinal edges are generally or nearly parallel until the edges diagonally indent inward at 60*f* and then continue in a parallel or nearly parallel direction 60*d* until the actuating lever 60 forms the base 60*b*. The base 60*b* of the actuating lever has a heel formation 60*g* and a horizontal cavity 60*c* that extends all the way through the base 60*b*. The lower surface of the base 60*b* touches the upper surface of the upper arm 14. The rotational disc 62 is a planar member that is circular or oval in shape with opposite facing mounting ears 64 and 76 extending vertically from the edges 82 and 84 of the axial passage 78 in the rotational disc 62. The mounting ears 64 and 76 each have a cavity 66 aligned with the other. The actuating lever's 60 base 60*b* fits into the axial passage 78 of the rotational disc 62. The base's 60*b* cavity 60*c* is aligned with the mounting ears' 64 and 76 cavities 66, and a pin through the cavities 60*c* and 66 fastens the actuating lever 60 to the rotational disc 62.

Instead of the scroll-like slots 46 on the side walls 4 and 6 as in FIG. 1, FIGS. 8, 9 and 10 portray longitudinal slots 74 in each of the side walls 4 and 6. The upper edges 4*c* of the portions of the side walls 4 and 6 that extend above the upper surface of the elongate upper arm 14 indent diagonally at 70, continue in a longitudinal direction 68, and angle outward 72 proximate the jaw formations 14*a* and 2*a*. The angled and indented side walls formed by 68, 70, and 72 that form the indented niches have slots 74 on both side walls 4 and 6 where the rotational disc 62 rides and may rotate 360 degrees.

When the actuating lever 60 is in its active position (as portrayed in FIGS. 8 to 12), the actuating lever 60 slopes upward, away from the elongate upper arm 14 with the heel formation 60*g* against the upper surface of the upper arm 14. In its active condition, the mounting ears 64 and 76 of the rotational disc 62 provide side barriers for the actuating lever 60, preventing the actuating lever 60 from slipping sideways during use of the device 30. During use of the device 30, the grasping end 60*e* is pressed toward the upper arm 14. The heel formation 60*g* mounting bears against the upper surface of the upper arm 14, forcing the upper jaw formation 14*a* of the upper arm 14 against the lower jaw formation 2*a*. The heel formation 60*g* also keeps the actuating lever 60 in its active position by preventing the actuating lever 60 from falling towards the upper arm 14.

In order to alternate the actuating lever 60 to its inactive condition, the grasping end 60*e* is lifted so that the heel formation 60*g* no longer rests against the upper surface of the upper arm 14. The actuating lever 60 - rotational disc 62 unit is rotated 180 degrees so that the upper surface of the active actuating lever 60 faces downward and becomes parallel to the upper arm 14, resting against the upper arm 14 until the device 30 is rotated back into its active condition. The rotational disc 62 rotates within the longitudinal slots 74 of the side walls 4 and 6.

The foregoing descriptions of the preferred and modified embodiments of the invention have been presented for the purposes of illustration and description. They are not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An actuating lever for use with a finger/toe nail clipper assembly of the type which includes elongate upper and lower arms arranged spaced in overlying arrangement and having first and second ends, the first ends being secured together and the second ends terminating in facing jaw formations respectively terminating in facing sharpened cutting edges, the upper arm being of limited resilience and capable of being forcably pressed toward the lower arm to place the sharpened cutting edges in severing engagement with a finger/toe nail introduced therebetween; said actuating lever comprising a mounting plate seatable over the upper arm at a location proximate the jaw formation thereof and an elongate rotatable portion having a grasping end and an opposite end; said mounting plate including a front section having a unitary angular arm defining a canted surface and a leading edge opposite said front section; said opposite end of said elongate rotatable portion having a unitary angular bend defining a canted surface complementary to the canted surface of said front section; aligned bores formed respectively in said angular arm and said angular bend; fastening/bearing means passing through said aligned bores coupling said angular arm and said angular bend in substantially canted surface to canted surface together enabling said lever portion to rotate relative said angular arm between an active condition directed divergently of the upper arm and a passive condition inverted from its active condition with the grasping end of said lever portion closely proximate said upper arm, and means for mounting said mounting plate to the finger/toe nail clipper assembly.

2. The actuating lever according to claim 1 in which said canted surfaces of said angular arm and said unitary angular bend are oriented at complementary acute angles.

3. The actuating lever according to claim 1 in which said front section includes a planar section which is seatable over the upper arm at a location proximate the jaw formations.

4. The actuating lever according to claim 1 in which said unitary bend defines a heel formation having a portion capable of preventing undesired movement of said elongate rotatable portion during use of said assembly.

5. The actuating lever according to claim 1 in which said unitary bend of said elongate rotatable portion defines a heel formation having a wide edge capable of bearing against said upper arm when said actuating lever is in its active condition whereby to prevent undesired rotation of said elongate rotatable portion during use of said assembly.

6. An actuating lever for use with a finger/toe clipper assembly of the type which includes elongate upper and lower arms arranged in overlying spaced planes, the arms each having first and second ends; the second ends being secured together; the first ends terminating in facing jaw formations terminating in facing jaw formations each terminating in sharpened cutting edges; the upper arm having limited resilience and the lower arm having generally vertical side walls along the longitudinal edges thereof and passage means formed in the side walls for mounting the actuating lever; said actuating lever comprising: a planar mounting disc having diametrically opposite edge portions and an axial opening; vertically oriented ear means carried by said disc adjacent said axial opening; said ear means having aligned bores; a base and an elongate outwardly extending lever portion unitary therewith; said base having means outwardly extending therefrom and seated within said aligned bores of said ear means pivotally securing said base to said planar mounting disc; said mounting disc being placable over the upper arm between the side walls and being capable of 180 degrees rotation with said diametrically opposiite edge portion arranged to ride within the passage means to position said elongate lever portion between an active condition whereat said elongate lever portion overlies the upper arm and is capable of being pivoted whereby the base is effective to exercise force upon the upper arm bringing the cutting edges of the jaw formations in severing engagement with a finger/toe nail introduced therebetween, and a passive condition enabling said elongate lever portion as to be incapable of exercising force upon the upper arm sufficient to effect severing of the finger/toe nail.

7. The actuating lever according to claim 6 wherein said base includes a heel formation capable of applying force against the upper arm when said elongate lever portion is minipulated while in its active condition.

8. The actuating lever according to claim 7 in which said base is generally rectangular and is provided with an rounded edge defining said heel formation.

9. The actuating lever according to claim 6 in which said planar disc is oval in perimetric configuration with a long axis and a comparably shorter axis; said planar disc being positionable over the upper arm with the long axis parallel lengthwise to the upper arm and capable of being rotated from a position with the long axis lengthwise along the upper arm to a position with the axial edge portions along the longer axis are disposed within said passage means and the axial edge portions along the shorter axis are along a line taken lengthwise along the upper arm, said planar disc being capable of being lifted from said upper arm for removal from said finger/toe nail clipper assembly.

10. The actuating lever according to claim 9 in which said planar disc is capable of rotating a further 180 degrees whereat said elongate lever portion is capable of being pivotally maniupulated to lift the base thereof from engagement with the upper arm of said clipper assembly with the lever portion is inverted from its active condition to assume its passive condition inverted and substantially parallel to the upper arm.

* * * * *